US011435164B2

(12) United States Patent
Clermont et al.

(10) Patent No.: US 11,435,164 B2
(45) Date of Patent: Sep. 6, 2022

(54) BORESIGHTING DEVICE AND METHOD

(71) Applicant: CMI DEFENCE S.A., Loncin (BE)

(72) Inventors: Bernard Clermont, Fleron (BE); Pierre Balthasart, Sprimont (BE); Igor Loiselle, Overijse (BE); Tristan Lilet, Liege (BE); Philippe Laurent, Embourg (BE)

(73) Assignee: CMI DEFENCE S.A., Loncin (BE)

( * ) Notice: Subject to any disclaimer, the term of this patent is extended or adjusted under 35 U.S.C. 154(b) by 953 days.

(21) Appl. No.: 16/305,065

(22) PCT Filed: May 29, 2017

(86) PCT No.: PCT/EP2017/062890
§ 371 (c)(1),
(2) Date: Nov. 28, 2018

(87) PCT Pub. No.: WO2017/207487
PCT Pub. Date: Dec. 7, 2017

(65) Prior Publication Data

US 2020/0370869 A1 Nov. 26, 2020

(30) Foreign Application Priority Data

May 31, 2016 (BE) ..... 2016/5399

(51) Int. Cl.
*F41G 3/32* (2006.01)
*F41G 1/54* (2006.01)
*F41G 3/22* (2006.01)

(52) U.S. Cl.
CPC ..... *F41G 3/326* (2013.01); *F41G 1/54* (2013.01); *F41G 3/22* (2013.01); *F41G 3/323* (2013.01)

(58) Field of Classification Search
None
See application file for complete search history.

(56) References Cited

U.S. PATENT DOCUMENTS

| | | | |
|---|---|---|---|
| 1,994,177 | A | 3/1935 | Nolan |
| 4,665,795 | A | 5/1987 | Carbonneau et al. |
| 7,124,676 | B1 | 10/2006 | Lowrance et al. |

FOREIGN PATENT DOCUMENTS

| | | | |
|---|---|---|---|
| DE | 3942922 | A1 | 6/1991 |
| EP | 1510775 | A1 | 3/2005 |
| EP | 1616145 | A1 | 1/2006 |
| FR | 2504668 | A1 | 10/1982 |

(Continued)

*Primary Examiner* — Hovhannes Baghdasaryan
(74) *Attorney, Agent, or Firm* — Leydig, Voit & Mayer, Ltd.

(57) ABSTRACT

A boresighting device to equip a turret provided with a barrel and one or several sight system(s) each with an optical system includes: a deflection target intended to be positioned outside the barrel, at a muzzle brake of the barrel; a housing intended to be positioned outside the barrel, at a shaft of the barrel. The housing includes: a first optics system provided with a deflection camera, the first optics system being used to determine a parallelism error between a firing line from the shaft and that from the muzzle brake; and a second optics system provided with a boresighting camera, the second optics system being used to determine a parallelism error between the firing line from the shaft and an optics line from the sight system(s). The deflection target integrates a geometric figure serving as a reference point for the first optics system.

14 Claims, 2 Drawing Sheets

(56) References Cited

FOREIGN PATENT DOCUMENTS

| | | | |
|---|---|---|---|
| FR | 2505477 | A1 | 11/1982 |
| WO | WO 0227259 | A2 | 4/2002 |
| WO | WO 2004055466 | A1 | 7/2004 |

BORESIGHTING DEVICE AND METHOD

CROSS-REFERENCE TO PRIOR APPLICATIONS

This application is a U.S. National Phase application under 35 U.S.C. § 371 of International Application No. PCT/EP2017/062890, filed on May 29, 2017, and claims benefit to Belgian Patent Application No. BE 2016/5399, filed on May 31, 2016. The International Application was published in French on Dec. 7, 2017 as WO 2017/207487 under PCT Article 21(2).

FIELD

The present invention relates to a method and device for aligning the line of sight with the firing line, commonly called boresighting device, for weapons systems, preferably large caliber (75 mm to 140 mm).

BACKGROUND

On a weapons system, a misalignment between the firing line and the line of sight is detrimental to hit a target with precision. There are two main sources of misalignments. A first misalignment source is the physical deformation of the barrel, commonly called deflection, which appears naturally and inevitably, both horizontally and vertically, as a result of the relatively heavy weight of the barrel and the outside conditions (rain, wind, sun, etc.). This deformation causes a parallelism flaw between the firing line from the shaft of the barrel and the firing line from the muzzle of the barrel. A second source of misalignment lies in the impacts and vibrations experienced during driving and shot firings that cause a deviation relative to the alignment previously calibrated.

Different devices exist for aligning the firing line with the line of sight, or in other words, boresighting a weapons system.

There are traditional boresighting techniques where the device is based on the cooperation between two operators, the first being located in the turret while the second, outside the turret, stays close to the muzzle of the barrel. The principle is based on optical collimator and described in document U.S. Pat. No. 1,994,177. The collimator is placed inside the tube of the barrel by the second operator and gives the first operator a view aligned with the firing line. In other words, the second operator informs the first operator how it is necessary to move the barrel so that he can see, through the observation hole, how the reference target is positioned. One major drawback of this device is that it requires two operators, including one outside the vehicle, i.e., directly exposed to an outside threat. Furthermore, it requires a ladder in order for the second operator to be able to reach the muzzle brake.

There are also devices of the "Muzzle Reference System" (MRS) type. These devices, described inter alia in document U.S. Pat. No. 4,665,795, are generally made up of a laser transceiver situated at the base of the barrel and a mirror placed at the muzzle of the barrel. The transmitter sends an infrared laser ray toward the mirror, which is next reflected toward the receiver. Based on the position of the laser received by the receiver, a piece of electronic equipment allows the automatic calculation of the azimuth and elevation corrections, which are next added to the ballistic corrections at the shot firing control system. One drawback of these devices is that the mechanical stability of the mirror is very complex to provide. Furthermore, detecting the arc lines of the barrel via laser measurements can make the system detectable by the enemy. Next, although devices of the MRS type make it possible to correct the variations in the arc lines of the barrel, an initial alignment remains necessary.

Similarly, the document FR 2 505 477 discloses a boresighting device which comprises on the barrel a deflection target formed by a mirror on which a crosshairs is projected, a housing comprising optics systems and an image sensor, the images are, on the one hand, the reflected image of the crosshairs and, on the other hand, in the presence of a filter, the reflected image of a distant object. It is again a precarious system wearing out with low stability and with the risk of deterioration of the precision of the optics systems in the long run.

Other, less widespread devices may also be cited.

Document EP 1,510,775 describes a device with a camera having two focusing levels. This camera is inserted in the chamber of the barrel during the boresighting operations. A first focusing at the muzzle of the barrel makes it possible to estimate its angular deviation (X,Y). A second infinity focusing makes it possible to observe an object situated at a far distance, and therefore to bring the view of the optical system back onto the same reference. The boresighting is done by combining these two operations.

Document EP 1,616,145 discloses a boresighting device done by a single operator located inside the turret. A camera is pushed to the muzzle of the barrel from the inside of the latter. Since this camera is situated at the muzzle of the barrel, it implicitly takes the arc line of the barrel into account.

These two devices have the drawback of having to position a camera inside the barrel. In the case of document EP 1,616,145, deploying the camera is a time-consuming and tedious operation, especially if it must be done by a single operator situated in the turret. Furthermore, it is not possible to guarantee that the orientation of the camera pushed to the muzzle will systematically be the same upon each boresighting operation.

SUMMARY

In an embodiment, the present invention provides a boresighting device to equip a turret provided with a barrel and one or several sight system(s) each with an optical system, the device comprising: a deflection target intended to be positioned outside the barrel, at a muzzle brake of the barrel; a housing intended to be positioned outside the barrel, at a shaft of the barrel, the housing including: a first optics system provided with a deflection camera, the first optics system being used to determine a parallelism error between a firing line from the shaft and that from the muzzle brake; and a second optics system provided with a boresighting camera, the second optics system being used to determine a parallelism error between the firing line from the shaft and an optics line from the sight system(s), wherein the deflection target integrates a geometric figure serving as a reference point for the first optics system.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
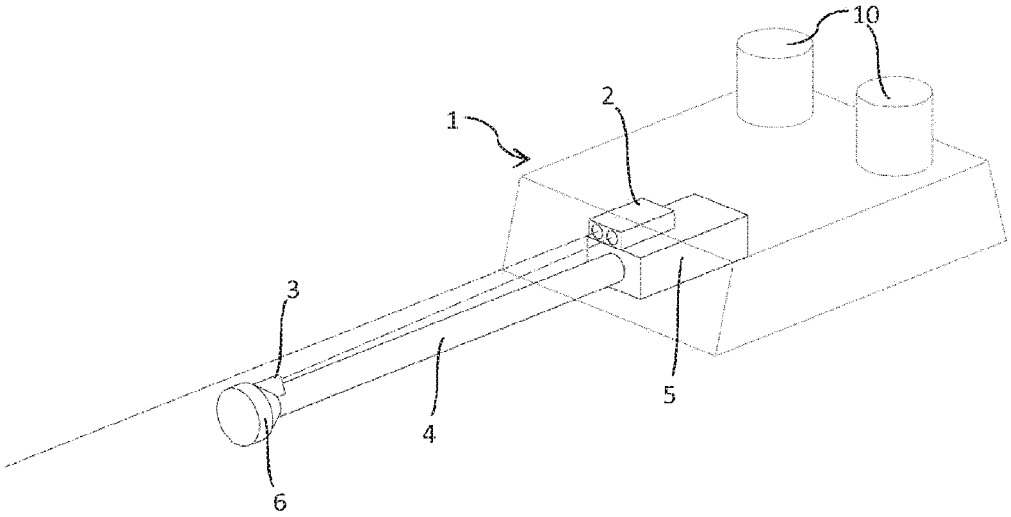
FIG. 1 schematically shows a turret provided with the boresighting device according to the invention, in the presence of the shaft, the barrel and the sighting optics, as well as the optical axes of the two cameras of the boresighting device.

An aspect of the present invention provides a boresighting device and method that require only one operator located inside the turret.

An aspect of the present invention provides a device not requiring an optics system inside the barrel. An aspect thus provides a device which is stable and precise.

An aspect of the present invention provides a boresighting method that is quick, while also being repeatable.

The present invention relates to a boresighting device to equip a turret provided with a barrel and one or several sight system(s) each with an optical system, said device comprising:

- a deflection target intended to be positioned outside the barrel, at the muzzle brake of said barrel,
- a housing intended to be positioned outside the barrel, at the shaft of said barrel, said housing including:
- a first optics system provided with a deflection camera, said first system being used to determine a parallelism error between a firing line from the shaft and that from the muzzle brake,
- a second optics system provided with a boresighting camera, said second system being used to determine a parallelism error between the firing line from the shaft and an optics line from the sight system(s).

According to specific embodiments of the invention, the device includes at least one or a suitable combination of the following features:

- each camera has fixed focusing, the boresighting camera having infinity focusing and the deflection camera being configured to have focusing adjusted on the deflection target;
- the deflection target includes any geometric material figure serving as a reference point for the first optics system, said geometric figure preferably being a circle.

The present invention also relates to a weapons system comprising the boresighting device as described above, wherein the housing is positioned on the shaft of the barrel and said deflection target is positioned near or on the perimeter of the muzzle brake of the barrel. Furthermore, in this weapons system, the deflection target can be attached or integrated with respect to the muzzle brake.

The present invention also relates to an armored vehicle provided with this weapons system.

The present invention also relates to a boresighting method using the device described above, said method comprising the following steps:

- Calculating the displacement $\Delta X$ and $\Delta Y$ of the geometric figure relative to a reference position of said figure, said calculation being done based on image processing from the deflection camera, the parallelism error between the firing line from the shaft and that from the muzzle brake next being determined via a mathematical model based on calculated $\Delta X$ and $\Delta Y$ values,
- Comparing an image taken by the boresighting camera with an image taken by an optical system of the sight system(s) in order to determine the parallelism error between the firing line from the shaft and the optics line from the sight system(s),
- Accumulation of two parallelism errors and displacement of said optics line accordingly.

According to specific embodiments of the invention, the method includes at least one or a suitable combination of the following features:

- the calculation of $\Delta X$ and $\Delta Y$ is done using an algorithm based on a contour detection according to the Canny method and using a Hough transform;
- the reference position of the geometric figure is calculated during a calibration following an installation of the boresighting device on a weapons system;
- the calibration is done using a muzzle bezel, said calibration comprising a step for aligning a position of a crosshairs of the boresighting camera with a point observed through the muzzle bezel;
- after the step for calculating the parallelism error between the firing line from the shaft and that from the muzzle brake, the crosshairs of the boresighting camera is moved by a same angle along the X and Y coordinates;
- the method can be implemented during a mission.

Lastly, the present invention relates to a computer program suitable for implementing the method described above and by recording data readable by a computer comprising this program.

The present invention relates to a boresighting device and the method implemented using said device. The device according to the invention is preferably intended for large caliber weapons systems (75 mm to 140 mm). It could nevertheless be used for small and/or medium caliber weapons systems subject to certain developments related to the steric bulk in the riggings associated with said calibers.

Figure 2:
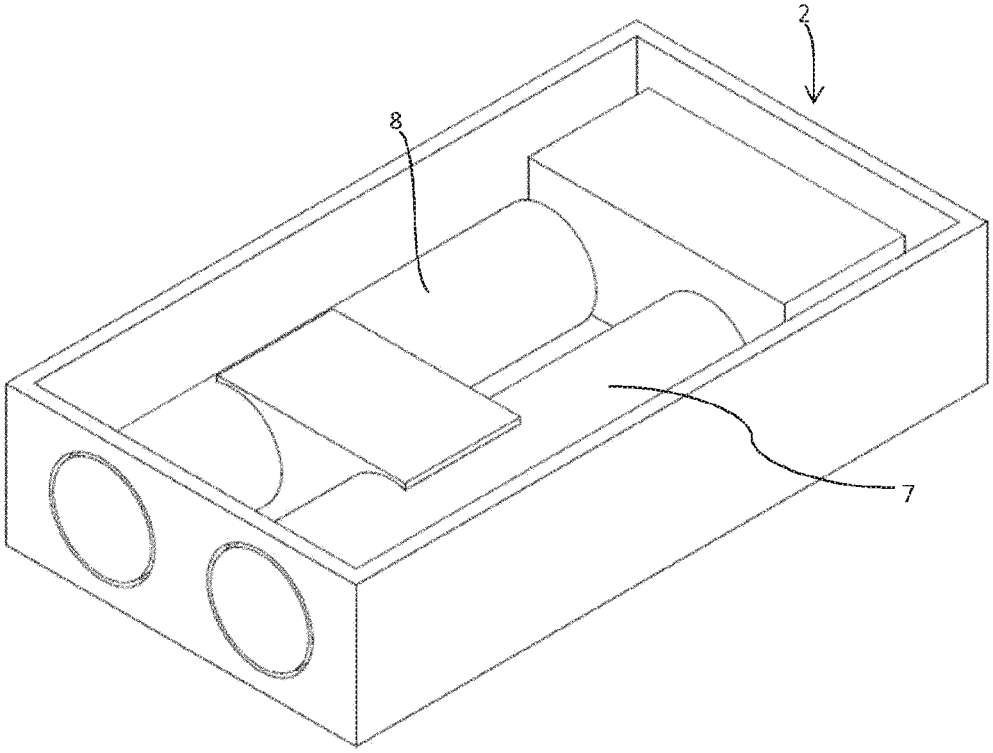
FIG. 2 schematically shows the optics systems inside the housing according to the invention.

The boresighting device according to the invention is shown in FIG. 1 on a turret 1. The device is made in two parts positioned in separate locations. It includes a housing 2 on the one hand, and a deflection target 3 on the other hand. The housing 2 is positioned outside the barrel 4, and preferably mounted on the shaft 5 of the barrel 4. The housing 2, visible in more detail in FIG. 2, includes two optics systems 7, 8 each provided with a camera. A first camera 7, called deflection camera, is intended to correct the misalignment resulting from the deflection of the barrel, i.e., the misalignment between the firing line from the shaft and that from the muzzle of the barrel. A second camera 8, called boresighting camera, is intended to correct the misalignment between the firing line from the shaft of the barrel and the optical axis of the sight system. In the housing, the two cameras are mounted in a single block. The boresighting and deflection cameras have the feature of having fixed focusing, respectively infinity focusing and focusing at the muzzle brake, as illustrated in FIG. 1. Mounting in a single block with fixed focusing for each camera has the advantage that no moving part is required in the housing, which makes it possible to ensure mechanical stability thereof relative to the impacts and vibrations related to shot firings. Furthermore, the housing is designed athermally so that the position of the optics axis of the cameras is not sensitive to temperature variations. In addition to the housing, the device includes the deflection target 3, which is located at the muzzle brake 6, i.e., at the end of the barrel where the ammunition exits. This deflection target 3 can be either an additional part that is placed at the fastening of the muzzle brake, or it can be integrated directly on the perimeter thereof. The latter alternative is favored to guarantee the mechanical stability of the device. The deflection target is provided with any geometric figure serving as a reference point for the optics system 7. This figure is physical, or tangible in other words, on the target which means that it is integrated on the target. It is thus not a projected figure on a mirror acting as a deflection target.

The boresighting method according to the invention takes into account both of the aforementioned misalignment causes, i.e., the deflection of the barrel and the deviation between the firing line and the sight line following impacts caused by the use of the vehicle and its weapons system.

To that end, the method is based on three steps.

Figure 3:
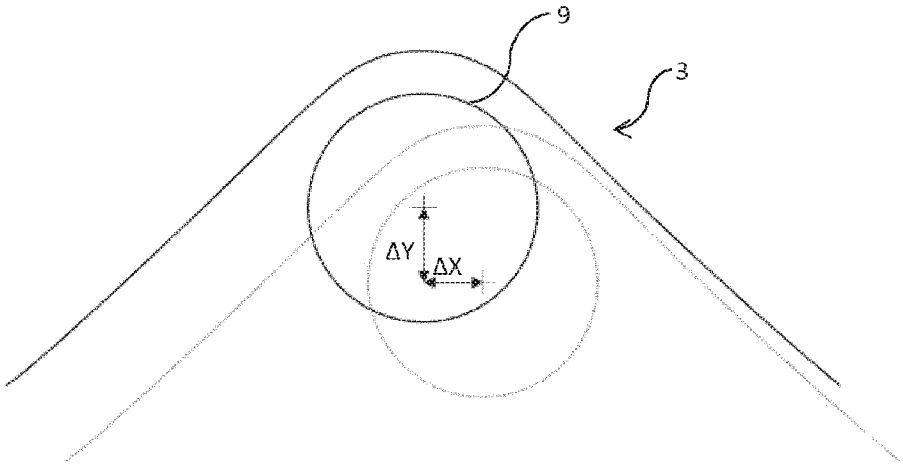
FIG. 3 illustrates the movement of the geometric figure over the deflection target following deflection of the barrel.

In a first step, the optics system provided with the deflection camera is used to determine the parallelism error between the firing line from the shaft and that from the muzzle brake. More specifically, the first optical system 7 of the housing detects the position of the deflection target via image processing such that the system can deduce, vertically and horizontally, the deflection of the barrel relative to a reference position obtained during calibration of the device. The movement along X and Y, i.e., the delta X ($\Delta X$) and delta Y ($\Delta Y$), is calculated relative to a reference embodied by the geometric figure that is preferably a circle 9 on the deflection target 3 (see FIG. 3). It is possible to consider other geometric forms, having previously made several specific modifications to the algorithms used. A $\Delta X$ and $\Delta Y$ are thus calculated relative to the starting position of the center of the circle. Through a mathematical model, the system produces the parallelism error therefrom between the firing line at the shaft and the firing line at the muzzle brake. The algorithm used to detect a geometric figure is based on a contour detection according to the Canny method. A Hough transform makes it possible to obtain a first estimate of the position of the reference circle. Next, an algorithm makes it possible to refine the obtained results at the sub-pixel level.

In a second step, the optics system provided with the boresighting camera is used to determine the parallelism error between the firing line at the shaft and the sight line. The camera whose axis is parallel to the firing line at the shaft and which uses infinity focusing provides an image of a distant object that is directly compared to the image provided by the optics system(s) 10 of the sight system(s) of the turret (FIG. 1). It is thus possible to deduce the parallelism error between the firing line at the shaft and the optics line of the sight system(s).

In a third step, the two parallelism errors are accumulated and sent directly to the sight system(s) of the turret.

Prior to these steps, the device must be calibrated. This calibration is done when the housing and the target are mounted on the turret. Subsequently, no new calibration is required as long as the housing and the deflection target are not moved. The calibration is done from a conventional muzzle bezel. This calibration consists of aligning the position of the crosshairs in the boresighting camera with the point observed by the muzzle bezel. This operation is done by one of the occupants of the turret via his control monitors. When this alignment is achieved, the reference position of the geometric figure is calculated and stored by the device. During subsequent boresighting operations, in the first step, the device measures the displacement of the geometric figure relative to that obtained during the calibration. This difference is next reflected in the boresighting camera by moving the position of its crosshairs thereto.

Advantages of the Invention

The precision of the boresighting in the presence of the device according to the invention is equivalent to that encountered with the prior art devices, but without the drawbacks.

Thus, the boresighting is done by a single operator located inside the turret, without deploying any tools. There is therefore no heavy, and therefore slow, manipulation. This absence of manipulation also guarantees better repeatability of the measurements. Furthermore, this allows the boresighting to be done mid-mission.

According to the invention, the deflection target and its geometrical figure are physical. It is not a mirror on which a crosshairs is projected. Thus, the device according to the invention does not require layers of mirrors causing desynchronization risks and requiring systematic calibrations.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LEGEND (1) Turret
(2) Housing
(3) Deflection target
(4) Barrel
(5) Shaft
(6) Muzzle brake of the barrel
(7) Optics system provided with the deflection camera
(8) Optics system provided with the boresighting camera
(9) Geometric figure on the deflection target
(10) Optics of a sight system of the turret

The invention claimed is:

1. A boresighting device to equip a turret provided with a barrel and one or several sight system(s) each with an optical system, the device comprising:

a deflection target intended to be positioned outside the barrel, at a muzzle brake of the barrel;

a housing intended to be positioned outside the barrel, at a shaft of the barrel, the housing including:

a first optics system provided with a deflection camera, the first optics system being used to determine a parallelism error between a firing line from the shaft and that from the muzzle brake; and a second optics system provided with a boresighting camera, the second optics system being used to determine a parallelism error between the firing line from the shaft and an optics line from the sight system(s), wherein the deflection target is devoid of a mirror and integrates a geometric figure serving as a reference point for the first optics system.

2. The device according to claim 1, wherein each camera has fixed focusing, the boresighting camera having infinity focusing and the deflection camera being configured to have focusing adjusted on the deflection target.

3. The device according to claim 1, wherein the geometric figure comprises a circle.

4. A weapons system, comprising:

the boresighting device according to claim 1, wherein the housing is positioned on the shaft of the barrel and the deflection target is positioned near or on a perimeter of the muzzle brake of the barrel.

5. The weapons system according to claim 4, wherein the deflection target is attached or integrated with respect to the muzzle brake.

6. An armored vehicle provided with the weapons system according to claim 4.

7. A boresighting method using the device according claim 1, the method including the following steps:

calculating a displacement ΔX and ΔY of the geometric figure relative to a reference position of the figure, the calculation being done based on image processing from the deflection camera, the parallelism error between the firing line from the shaft and that from the muzzle brake next being determined via a mathematical model based on calculated ΔX and ΔY values;

comparing an image taken by the boresighting camera with an image taken by an optical system of the sight system(s) in order to determine the parallelism error between the firing line from the shaft and the optics line from the sight system(s); and accumulating the two parallelism errors and displacement of the optics line accordingly.

8. The method according to claim 7, wherein the calculation of ΔX and ΔY is done using an algorithm based on a contour detection according to the Canny method and using a Hough transform.

9. The method according to claim 7, wherein the reference position of the geometric figure is calculated during a calibration following an installation of the boresighting device on a weapons system.

10. The method according to claim 9, wherein the calibration is done using a muzzle bezel, the calibration comprising a step for aligning a position of a crosshairs of the boresighting camera with a point observed through the muzzle bezel.

11. The method according to claim 7, wherein, after the step for calculating the parallelism error between the firing line from the shaft and that from the muzzle brake, the crosshairs of the boresighting camera is moved by a same angle along the X and Y coordinates.

12. The method according to claim 7, able to be implemented mid-mission.

13. A computer program suitable for implementing the method according to claim 7.

14. A means for recording data readable by a computer, comprising:

the computer program according to claim 13.

* * * * *